US005128909A

United States Patent [19]

Stein

[11] Patent Number: 5,128,909

[45] Date of Patent: Jul. 7, 1992

[54] ADVANCED CLOCK MEASUREMENT SYSTEM

[75] Inventor: Samuel R. Stein, Boulder, Colo.

[73] Assignee: Ball Corporation, Muncie, Ind.

[21] Appl. No.: 569,067

[22] Filed: Aug. 17, 1990

[51] Int. Cl.[5] ..... G04B 18/00; G04B 17/20

[52] U.S. Cl. ..... 368/200; 368/202; 331/44; 331/55; 324/782; 324/85

[58] Field of Search ..... 368/202, 200; 331/38, 331/44, 55, 56; 324/782, 83 Q, 85

[56] References Cited

U.S. PATENT DOCUMENTS

| | | | |
|---|---|---|---|
| 3,379,992 | 4/1968 | Hoo | 331/38 |
| 3,518,567 | 6/1970 | Helgesson | 331/44 |
| 3,826,995 | 7/1974 | Miller | 331/38 |
| 4,303,893 | 12/1981 | Goldberg . | |
| 4,440,501 | 4/1984 | Schulz | 368/202 |
| 4,525,685 | 6/1985 | Hesselberth et al. . | |
| 4,843,328 | 6/1989 | Greenhall . | |
| 4,845,692 | 7/1989 | Groslambert | 368/200 |
| 4,943,955 | 7/1990 | Rabian | 368/200 |

OTHER PUBLICATIONS

Stein et al., "Performance of an Automated High Accuracy Phase Measurement System", Proceedings of the 36th Annual Symposium on Frequency Control, pp. 314–320, Jun., 1982.

*Primary Examiner*—Kenneth A. Wieder
*Assistant Examiner*—Jose M. Solis
*Attorney, Agent, or Firm*—Gilbert E. Alberding

[57] ABSTRACT

A system to measure time based on the output of a plurality of clocks employs a common oscillator, rather than a frequency synthesizer. Phase differences between a plurality of clocks are measured by mixing the output from each clock with the output of the common oscillator and detecting the zero crossing of each of the resulting beat signals. The zero crossings are counted and used to start and stop time interval counters, which count the time intervals between zero crossings of the beat signals from different clocks. The output of one of the clocks is used to provide a time base. The output of the first clock is input to a divider, and the divided signal used to start the first of the time interval counters. The number of zero crossings of the divided signal are also counted so that the relative frequency of the common oscillator can be determined. The output of the divider can be synchronized with an external clock.

28 Claims, 5 Drawing Sheets

ADVANCED CLOCK MEASUREMENT SYSTEM

BACKGROUND OF THE INVENTION

1. Field of the Invention

The present invention relates to a method and system for measuring the time difference between a plurality of high-precision clocks. More particularly, the present invention relates to a simplified extended dual mixer time difference measurement system which employs a common oscillator as opposed to a synthesizer, thereby reducing the cost of the system and eliminating noise produced by a synthesizer.

2. Description of the Related Art

The ability to measure a precise period of time or keep accurate time has become increasingly important to both the scientific and commercial world in this era of high-speed computers and communications. The introduction of molecular or atomic clocks over 40 years ago brought timekeeping to an entirely new level of accuracy. Molecular clocks employ a molecular material, such as cesium or rubidium, which has a frequency output of a value which is essentially determined by the inherent characteristics of the material.

However, it was found that two molecular clocks employing the same material usually had frequency outputs that varied somewhat due to one or more of many factors. Factors which affect output frequency of molecular clocks include environmental factors such as temperature, the existence of magnetic fields, random fluctuations, frequency drift, and frequency and time offsets.

In the United States, the official "time" has been calculated by the National Bureau of Standards (NBS) from an ensemble of continuously operating cesium clocks. Frequency differences between clocks is addressed, with data of frequency calibrations and inter-clock comparisons being statistically processed to provide near-optimum time stability and frequency accuracy. The NBS time standard, as well as other similar standards, has been made available globally via satellites. Thus, the "time" has become available to parties at remote locations having the appropriate hardware and means for processing the signals. These signals, alone or in combination, were and remain used for several applications. For example, navigation systems of ships at sea utilize time signals from three or more of such satellites to determine their location. However, these applications require specialized receiving equipment, and are subject to problems from a number of sources, such as atmospheric interference, etc. Therefor, applications which require extremely high precision, reliability and/or some sort of detection avoidance are not best served by the satellite time signals.

Recently, the need for high-precision timekeeping has been ever increasing, and the use of dedicated molecular clocks has become quite common in a wide variety of applications. For example, naval vessels use molecular clocks to keep highly accurate time for a variety of functions, including classified communications and on-board tactical systems. Scientific experiments that are time dependent, especially in areas such as physics, often require that extremely accurate time measurements be made. Further applications include electronic monitoring or eavesdropping. However, in many of these applications, the use of a single molecular clock does not guarantee the precision timekeeping required. In many of these situations, the use of an ensemble of two or more clocks would provide the desired precision. But when an ensemble of clocks is used, the "time" is realized by processing the times and frequencies of the clocks together. However, the cost of the required signal processing hardware has been prohibitive and the reliability somewhat less than satisfactory, thereby limiting the use of ensembles in the face of an ever-increasing demand for precision that only an ensemble can provide.

As discussed above, when an ensemble of clocks is employed, hardware is necessary for comparing times and frequencies and deriving the differences so that a calculation of the "time" based on the output of all the clocks can be made. A variety of techniques for doing so are presently employed. One of the more advanced techniques is the extended dual mixer time difference measurement technique, which was developed by the present inventor. Like most prior art measurement techniques, the extended dual mixer technique ties the "time" from each clock to a time base, which is a signal having a known frequency synthesized from one of the clocks in the ensemble. One significant feature of the extended dual mixer technique is the use of scalers to count zero upcrossings in the beat signal derived from each clock. Prior dual mixer techniques were able to detect phase differences between beat signals, but an ambiguity problem remained that these techniques could not measure. This ambiguity is also referred to as a difference in the epoch of the signals. Over a period of time, frequency differences between the beat signals derived from different clocks often result in a difference in the number of cycles completed by respective beat signals. Generally, no error would be introduced over short measurement periods, as the epoch of the signals would ordinarily remain the same. However, over longer measurement periods, the total number of cycles completed would often be different for each beat signal, an error that the prior techniques did not address.

The extended dual mixer technique eliminated the ambiguity problem by adding scalers to count the zero upcrossing of each cycle of the beat signal for each clock. In this way, both the phase difference and the cycle ambiguity between clocks in an ensemble could be ascertained. This time measurement system required less supervision than its predecessors and provided data to a computer which permitted a more accurate representation of the time to be derived from the ensemble.

However, the extended dual mixer technique remains subject to problems that have haunted time measurement systems for ensembles. The most important of these problems are reliability, noise produced by the various components of the system, sensitivity of the components to environmental factors such as temperature, complexity and expense. Clearly, if the expense of such measurement systems was reduced and their reliability increased, clock ensembles and their required hardware would receive wider acceptance in the existing markets that are demanding precision timekeeping.

SUMMARY OF THE INVENTION

Accordingly, one object of the present invention is to provide a simplified and reliable extended dual mixer time difference measurement system.

A further object of the present invention is to provide a clock measurement system which is less expensive to manufacture.

Another object of the present invention is to provide an advanced clock measurement system which operates without a synthesizer.

Yet another object of the present invention is to provide an advanced clock measurement system which has less inherent noise.

Yet another object of the present invention is to provide an inexpensive advanced clock measurement system which can be utilized in a variety of applications.

A still further object of the present invention is to provide a clock measurement system which can obtain a more accurate analysis of ensemble time.

Other objects and advantages of the present invention will be set forth in part in the description and drawings which follow, and, in part, will be obvious from the description, or may be learned by practice of the present invention.

To achieve the foregoing objects and in accordance with the purpose of the present invention, as embodied and broadly described herein, a measurement system for observing time differences between at least two oscillators of an ensemble according to the present invention comprises: a common oscillator, separate from the oscillators of the ensemble for producing a first output signal; a mixer associated with each of the oscillators of the ensemble for mixing an output signal from its associated oscillator with the first output signal; a divider for dividing the output signal from a first of the oscillators of the ensemble; a counter for counting zero crossings of each of the signals output by the mixers and the divider; counters for counting the time intervals between the zero crossings of the mixer associated with the first oscillator and the mixers associated with the remaining oscillators and the dividers; and a computer for determining time differences between the at least two oscillators based on the counted zero crossings and the counted time intervals. Preferably, the zero crossings are zero upcrossings of the respective signals, and the divider comprises a synchronous divider. The divider can also synchronize the divided signal with an externally supplied signal. The oscillators measured by the system can be molecular or, more particularly, cesium clocks.

The present invention also discloses a system for measuring the phase differences between clocks in an ensemble, comprising: an common oscillator for producing a first signal; a divider for dividing a signal output by a first clock of the ensemble; a scaler for counting the zero upcrossings of the divided signal; a plurality of channels, one associated with each clock in the ensemble and each comprising a mixer for mixing an output signal of its associated clock with the first signal, a detector for detecting zero upcrossings of the output of the mixer, a counter for counting a time interval between a start signal and the zero upcrossing of the associated clock, and a counter for counting the number of zero upcrossings detected by the detector; and a computer or like device for determining the phase differences between the clocks of the ensemble based on the output of the scaler and the counters of each channel. Preferably, the start signal is a zero upcrossing of the divided signal for the channel associated with the first clock and a zero upcrossing of the mixed signal from the first channel for the remaining clocks. Further, the divider is preferably a synchronous divider and can synchronize the signal from the first clock with an external signal.

The present invention further discloses a measurement system for observing time differences between at least two measuring oscillators comprising: a common oscillator, separate from the measuring oscillators, for producing a first output signal; at least two mixers, one associated with each of the measuring oscillators, each for mixing an output signal from the associated oscillator with the first output signal; a divider for dividing the output signal from a first of the measuring oscillators; detectors and counters for detecting and counting respective zero crossings of respective signals output from each of the mixers and the divider; time interval counters for counting time intervals between the zero crossings of the output of the divider and the outputs of each of the mixers; and a computer or processor for determining time differences between the measuring oscillators based on the counted zero crossings and counted time intervals. Preferably, the detectors and counters detect and count zero upcrossings of the respective signals and comprise zero crossing detectors, one associated with each of the mixers, for detecting the zero upcrossings, and scalers, one operatively connected with each of the divider and the zero crossing detectors, for counting the zero upcrossings. Additionally, the time interval counters preferably comprises a time interval counter operatively associated with each of the zero crossing detectors. Each of the time interval counters has a start input and a stop input, the start input of each time interval counter being connected to the output of the divider and the stop input of each time interval counter being connected to the output of its associated zero crossing detector.

The present invention will now be described with reference to the following drawings, in which like reference numerals denote like elements throughout.

DESCRIPTION OF THE PREFERRED EMBODIMENT

Figure 1:
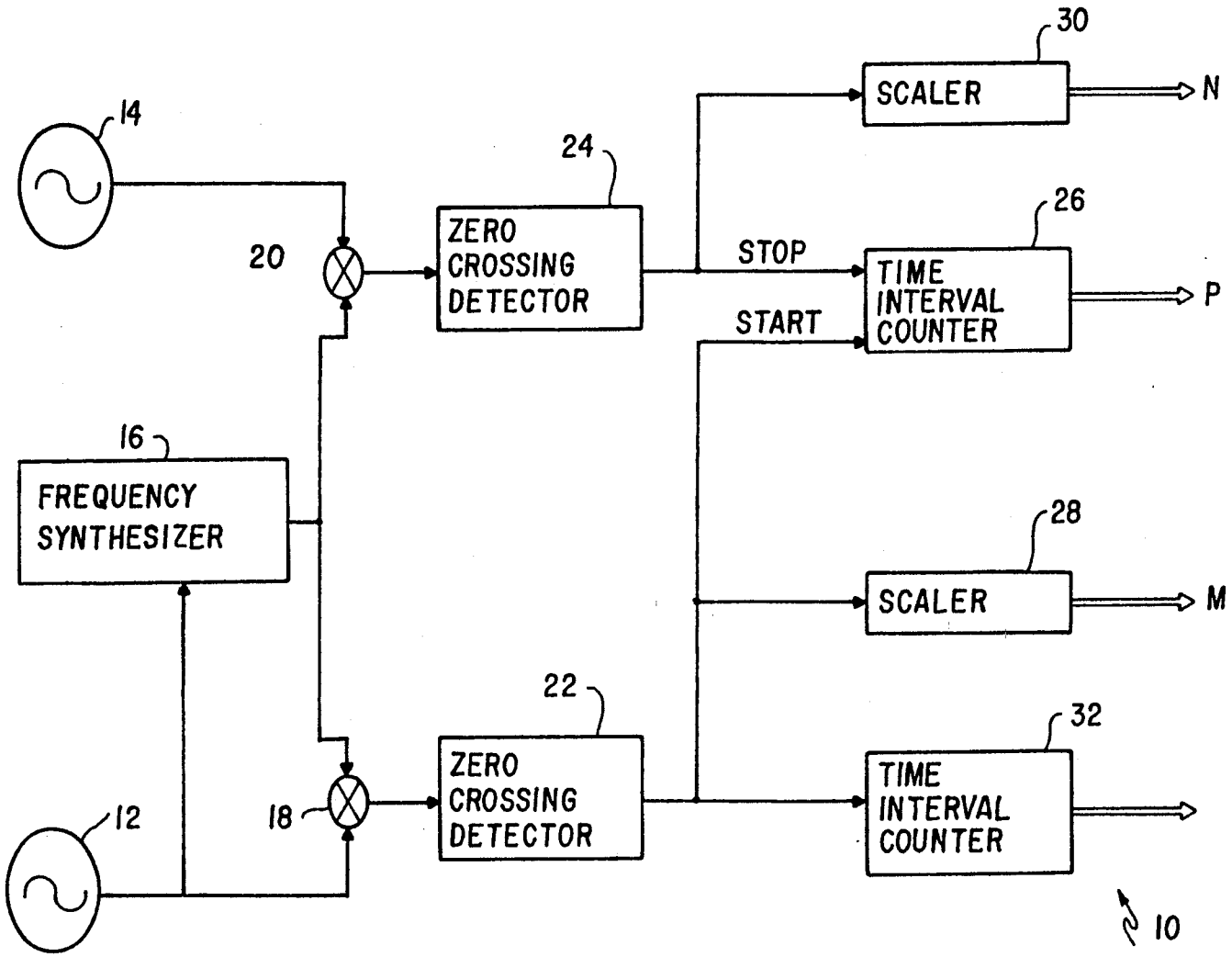
FIG. 1 (PRIOR ART)
FIG. 1 is a block diagram of a prior art extended dual mixer system.

Reference will be made in detail to the present preferred embodiment of the present invention, an example of which is illustrated in the accompanying drawings, after discussing a prior art clock measurement system, which is illustrated in FIG. 1.

An extended dual mixer time difference measurement system 10 is illustrated in FIG. 1. Two clocks or oscillators 12, 14 are illustrated in FIG. 1, but the system 10 can be expanded to accommodate any number of oscillators by adding an appropriate channel for each additional oscillator. Typically, each oscillator is a molecular clock of the same type, so that each produces an output frequency value which is approximately known and substantially similar. A frequency synthesizer 16 produces a signal with a known frequency offset from the output signal of the first oscillator 12, which is mixed with the output signals of the oscillators 12, 14 in mixers 18, 20, respectively. The output frequency of the synthesizer, $\nu_s$, is equal to $\nu_1(1-1/R)$ where $\nu_1$ is the frequency of the first oscillator 12 and R is any rational number. The output signal from the first mixer 18, also known as a beat signal, has a frequency equal to the frequency difference between the frequencies of the signals output by the first oscillator 12 and the synthesizer 16. Similarly, the output signal from the second mixer 20 has a frequency equal to the frequency difference between the signals output from the second oscillator 14 and the synthesizer 16. Since the frequencies of the signals output from the respective oscillators 12, 14 should be very close and the frequency of the signals applied to each mixer 18, 20 from the frequency synthesizer 16 is the same, the difference in frequency of the signals output from the first and second mixers 18, 20 should be small. Preferably, the frequency of the synthesized signal is relatively close to the frequency of the oscillators 12, 14, such that the frequencies of the beat signals output from the mixers 18, 20 are very low, such as on the order of 1 Hz to 1000 Hz.

It is a relatively easy procedure to precisely determine the phase difference between low frequency signals. The phase difference is found by detecting when each respective signal has a positive zero crossing, which is also referred to as a zero upcrossing. Respective zero upcrossings are detected by respective zero crossing detectors 22, 24. A time interval counter 26 is programmed to start counting when the first zero crossing detector 22 detects that the beat signal output from the first mixer 18 has a zero upcrossing, and to stop counting when the second zero crossing detector 24 detects that the beat signal output from the second mixer 20 has a zero upcrossing. The quantity P counted by the time interval counter 26 represents the phase difference between the first and second oscillators 12, 14 modulo $2\pi$. A second time interval counter 32 is provided in the channel associated with the first oscillator 12, but provides no additional information. To allow any channel to be used for the reference, each channel is assembled including a time interval counter. Since one channel is provided for each clock being measured, the time interval counter in one channel in the system (the reference channel) will always remain unused.

Figure 2:
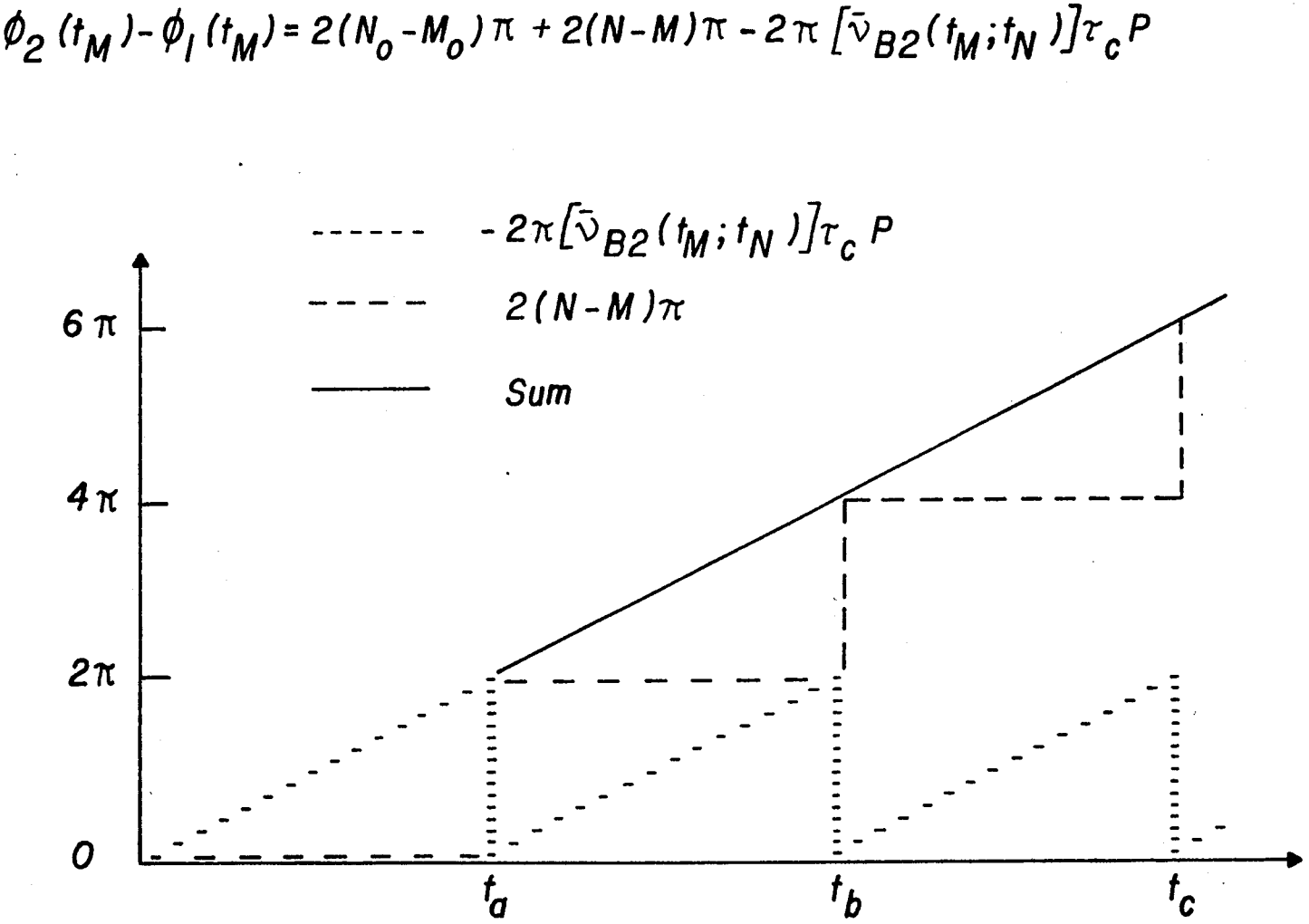
FIG. 2 (PRIOR ART)
FIG. 2 is a graph illustrating the data output from the prior art extended dual mixer system of FIG. 1.

The extended dual mixer system also accounts for phase differences on a different scale. Relatively large differences in frequency which may result in the beat signals having completed a different number of cycles over a given time period. This second magnitude of phase difference (also referred to as a difference in the epoch) is relatively common over longer periods of time. Scalers 28 and 30 count zero upcrossings M and N of the respective beat signals over a given period of time. A computer (not shown) then processes data output from the time interval counter 26 and the scalers 28, 30 first to determine the average frequency of the oscillators 12, 14 and then to determine the time difference between the outputs. Specifically, the counter outputs are combined to calculate the total phase difference between the oscillators as follows:

$$\phi_2(t_M)-\phi_1(t_M)=2(N_o-M_o)\pi-2\pi[\bar{\nu}_{B2}(t_M;t_N)]\tau_c P \quad (1)$$

where $\phi(t)$ represents phase, $\tau_c$ is the period of the time interval counter time base, $\bar{\nu}_{B2}(t_M;t_N)$ is the average beat frequency and P is the number of counts recorded in a measurement. The first term is a constant which represents the choice of the time origin and can be ignored. The last two terms and their sum are plotted in FIG. 2.

The average beat frequency $\bar{\nu}_{B2}(t_M;t_N)$ cannot be known exactly. However, it may be estimated with sufficient precision from the previous pair of measurements, designated ′ (prime) and ″ (double prime), respectively. The average frequency is approximately $$\bar{\nu}_{B2}(T_M;t_N)\approx(N''-N')/[R(M''-M')/\nu_{10}=\nu_{10}=\tau_c(-P] \quad (2)$$

The extended dual mixer system provides high resolution, is fully automatic due to the elimination of the ambiguity, outputs no phase errors caused by the switching of RF signals since there is no switching anywhere in the system, and is capable of comparing a very large number of oscillators. However, some problems still exist. For example, even though the system provides high resolution, the resolution is limited by noise to approximately 2 ps. Much of this noise is caused by the frequency synthesizer. Besides being the cause of excessive noise, the frequency synthesizer is one of the more expensive and complicated components in the system. For a variety of reasons, frequency synthesizers are commonly the source of output errors. Frequency synthesizers are prone to phase variations due to environmental factors, such as temperature and humidity. Further, given the complexity of frequency synthesizers, synthesizer failure is not uncommon. Attempts to create more precise and reliable synthesizers have inevitably resulted in more complex synthesizers which were even noisier and more expensive, thereby reducing the precision of the overall system while increasing its cost.

The present inventor has responded to these problems in a unique manner. Heretofore, a synthesizer was required in order to provide a signal having a known frequency offset from the reference oscillator in order to be able to compare the output signals from a plurality of oscillators. Rather than attempt to provide an improved synthesizer, the present inventor found that it is not necessary to use a synthesizer to calibrate a frequency offset from a common oscillator with respect to a reference clock. Rather, a simple circuit is used to provide the necessary information. The result is an improved extended dual mixer system which requires no synthesizer. This advanced clock measurement system 50 is illustrated in FIG. 3

Figure 3:
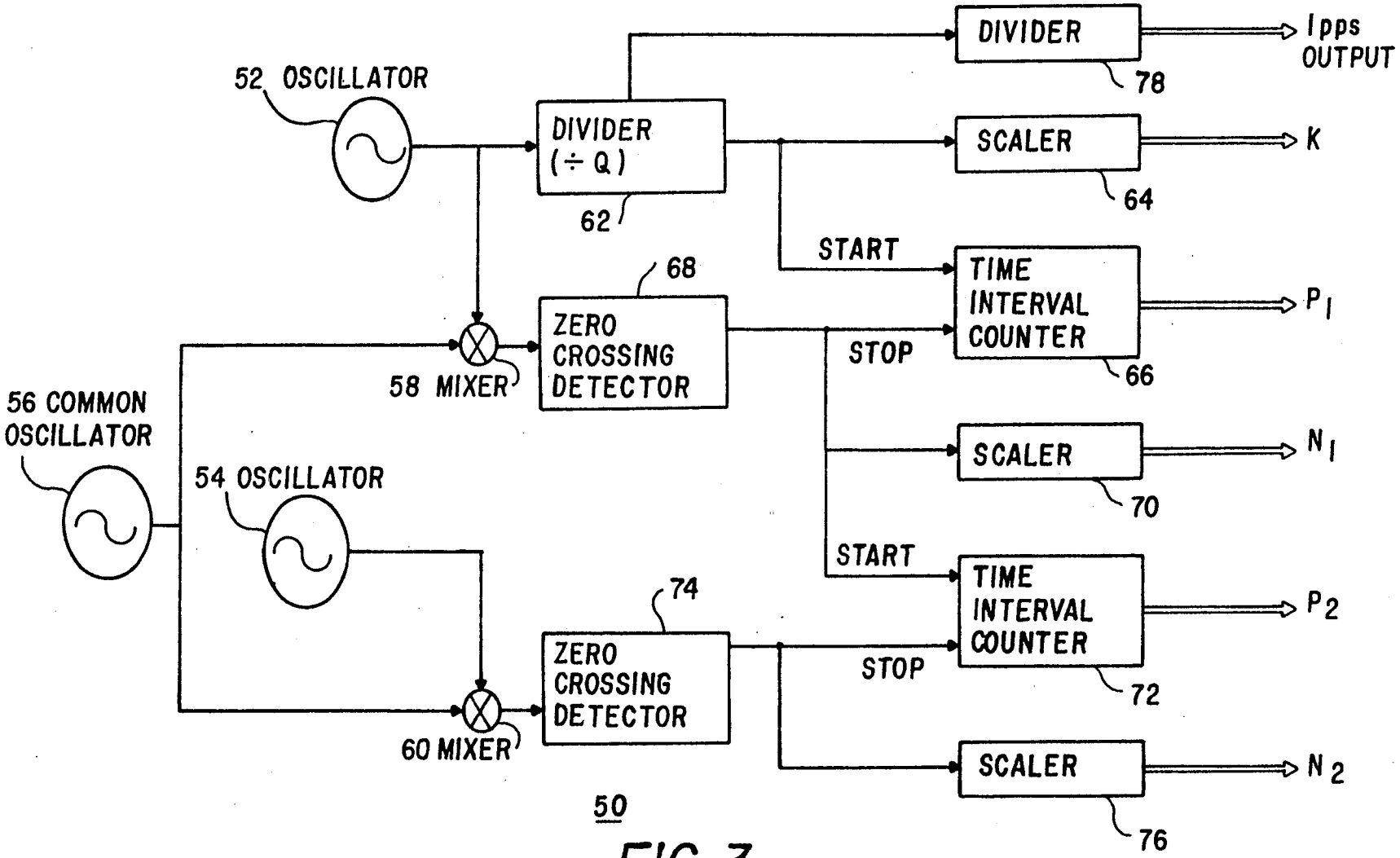
FIG. 3 is a block diagram of an advanced measurement system according to the present invention.

FIG. 3 is a circuit diagram of an advanced clock measurement system according to the present invention. An advanced clock measurement system 50 performs the same function as the prior art extended dual mixer system, but differs from the prior art extended dual mixer system in that the frequency synthesizer has been eliminated. Instead, an additional clock is required, which acts as a common oscillator, and a divider and an additional scaler have been added to the measurement circuit itself. The operation of the advanced clock measurement system 50 of FIG. 3 will now be described.

The advanced clock measurement system of the present invention is capable of being expanded to accommodate an ensemble having any number of clocks or oscillators. For ease of illustration and description, the advanced clock measurement system illustrated in FIG. 3 includes two oscillators 52, 54 which comprise an ensemble. Preferably, the oscillators 52, 54 are the same type of molecular clocks, such as cesium clocks. A channel is associated with each oscillator of the ensemble and includes a mixer, a zero crossing detector, a time interval counter and a scaler for processing the signal from the associated oscillator, as will be described below. A common oscillator 56, which is preferably a tunable oscillator with good short term frequency stability, outputs a signal to respective first inputs of a first mixer 58 and a second mixer 60. An output signal from the first oscillator 52 is provided to a second input of the first mixer 58. The resulting beat signal output from the first mixer 58 has a frequency equal to the frequency difference between the first and second inputs to the first mixer 58. Similarly, the signal output from the second oscillator 54 is input to a second input of the second mixer 60, and the beat signal output from the second mixer 60 has a frequency equal to the frequency difference between the outputs of the second oscillator 54 and the common oscillator 56. As discussed above, the mixer output is the frequency difference between oscillators, but the phase error is preserved so that it corresponds to an absolutely longer time interval. For example, $\pi$ radians at 5 MHz is 100 ns, but $\pi$ radians at 10 Hz is 0.05 s.

Since the advanced clock measurement system has eliminated the synthesizer, another way must be found to compare the outputs of clocks in an ensemble without the use of time base tied to one of the clocks (the synthesized signal of the extended dual mixer system). Additionally, the frequency of the first oscillator 52 relative to second oscillator 54 must be mathematically described without the use of the frequency of the common oscillator. This is possible through the use of a divider 62 and a scaler 64. In this way, the output of the first mixer 58 is tied to the output of the divider 62, and the frequency of the first oscillator 52 relative to the second oscillator 54 can be determined, as is explained below.

Preferably, the first oscillator 52 is a cesium clock. An ideal cesium clock has a frequency of 9,192,631,770 Hz, and time is measured using cesium clocks based on this ideal frequency. (As discussed above, the present invention resolves inaccuracy which arises from frequency offsets from this ideal frequency.) The divider 62 is used to change the frequency output by the first oscillator 52 into one more nearly equal to the frequency difference between oscillators 52 and 56 by dividing the frequency by a constant Q. Optionally, the signal can also be synchronized to an externally applied signal, or the signal can be further divided by a second divider 78 to obtain a signal having a different frequency, such as on the order of 1 pulse per second (pps), as will be explained below with reference to FIG. 4. The scaler 64 then counts the zero upcrossings of the signal output by the divider 62. By processing the signal from the first oscillator 52 in this way, there is no need to use a synthesizer to know a priori the phase and frequency of a common signal to be applied to the mixers, as the phase difference between the first and second oscillators can be described without reference to the properties of the common signal, as will be explained below.

The signal output from the divider 62 is also used as a start signal for a first time interval counter 66. A first zero crossing detector 68 detects the zero upcrossing of the beat signal output from the first mixer 58. Upon detection of a zero upcrossing, the first zero crossing detector 68 outputs a signal which acts as a stop signal for the first time interval counter 66. The signal output by the first zero crossing detector 68 is counted by a second scaler 70 and acts as a start signal for a second time interval counter 72 in the channel associated with the second oscillator 54. (In an ensemble having more than two oscillators, the signal output by the first zero crossing detector would act as a start signal for the time interval counter associated with every additional oscillator in the ensemble.) Similarly, a second zero crossing detector 74 detects zero upcrossings in the beat signal output by the second mixer 60. Upon detection of a zero upcrossing, the second zero crossing detector 74 outputs a signal which acts as a stop signal for the second time interval counter 72 and is counted by a third scaler 76. If the ensemble included more oscillators, additional channels would be required, one associated with each additional oscillator. The channels would be connected in parallel as described above, relative to the channels for the first and second oscillators 52, 54.

The outputs from the first, second and third scalers 64, 70, 76 and the first and second time interval counters 66, 72 are provided to a computer for calculating the phase difference between the first and second oscillators 52, 54. The output of the first scaler 64, which is the number of zero upcrossings during a given measurement period of the divided signal, is represented by K. The output of the first time interval counter 66 is represented by $P_1$. The output of the second scaler 70, which is the number of zero upcrossings of the beat signal derived from the first oscillator 52, is represented by $N_1$. The output of the second time interval counter 72 is represented by $P_2$. Lastly, the output of the third scaler 76, which is the number of zero upcrossings of the beat signal derived from the second oscillator 54, is represented by $N_2$.

A computer or processor of some type is employed to calculate the phase difference between the first and second oscillators by using the following relationships and calculations. The total phase of an oscillator is represented by $\phi(t)$. If the start time of the first interval counter 66 is designated $t_0$, then the phase of the first oscillator 52 can be represented by $$\phi_1(t_o)=2\pi K(t_o)Q. \tag{3}$$

Given that the stop time of the first time interval counter 66 is $t_1$, the phase difference between the first oscillator 52 and the common oscillator 56 at time $t_1$ is $$\phi_{1c}(t_1) \uparrow \phi_1(t_1)-\phi_c(t_1)=2\pi N_1(t_1). \tag{4}$$

The second time interval counter 72 starts on the stop pulse of the first time interval counter 66, which is $t_1$. Given that the stop time for the second time interval counter 72 is $t_2$, the phase difference between the second oscillator 54 and the common oscillator 56 at time $t_2$ is $$\phi_{2c}(t_2)=\phi_2(t_2)-\phi_c(t_2)=2\pi N_2(t_2). \tag{5}$$

The phase difference between the first and second oscillators 52, 54 can be obtained by subtracting equation (4) from equation (5) as follows:

$$\begin{aligned}\phi_{21}(t_2) &= 2\pi[N_2(t_2) - N_1(t_1)] - [\phi_{1c}(t_2) - \phi_{1c}(t_1)] \\ &= 2\pi[N_2(t_2) - N_1(t_1)] - 2\pi(t_2 - t_1)\nu_{1c}(t_2 - t_1),\end{aligned} \tag{6}$$

where $\bar{\nu}_{1c}(t_2-t_1)$, defined as $$\bar{\nu}_{1c}(t_2 - t_2) \equiv \frac{\phi_{1c}(t_2) - \phi_{1c}(t_1)}{2\pi(t_2 - t_1)}, \quad (7)$$

is the average frequency of the first oscillator 52 relative to the common oscillator 56 over the time interval from $t_1$ to $t_2$, and $N_1(t_1)$ and $N_2(t_2)$ are the number of zero crossings counted by scalers 70, 76 at times $t_1$ and $t_2$, respectively.

Although $\bar{\nu}_{1c}(t_2-t_1)$ is unknown, it may be estimated by using the data from two sets of measurements separated in time. The times associated with the earlier measurement are indicated by primes. Subtracting equation (4) evaluated at time $t_1$, from the same equation evaluated at time $t_1$ yields:

$$\bar{\nu}_{1c}(t_1 - t_1') = \frac{N_1(t_1) - N_1(t_1')}{t_1 - t_1'}. \quad (8)$$

Assuming that the first oscillator 52 is the time base for the time interval counters 66, 72, the start and stop of the first time interval counter 66 are related by $$t_1 = t_0 + \frac{P_1(t_1)}{\bar{\nu}_1(t_1 - t_0)}, \quad (9)$$

where $P_1(t_1)$ is the number of counts accumulated during the measurement cycle. Evaluating this relationship at the earlier time, subtracting and substituting equation (3), the expression for the elapsed time between stop pulses for the two measurements is as follows:

$$t_1 - t_1' = \frac{Q[K(t_0) - K(t_0')]}{\bar{\nu}_1(t_0 - t_0')} + \frac{P_1(t_1)}{\bar{\nu}_1(t_1 - t_0)} - \frac{P_1(t_1')}{\bar{\nu}_1(t_1' - t_0')}. \quad (10)$$

The phase difference between the first and second oscillators 52, 54 is obtained by substituting equations (7) and (9) in equation (6) as follows:

$$\phi_{21}(t_2) = 2\pi[N_2(t_2) - N_1(t_1)] - \frac{2\pi(t_2 - t_1)[N_1(t_1) - N_1(t_1')]}{\frac{Q[K(t_0) - K(t_0')]}{\nu_1(t_0 - t_0')} + \frac{P_1(t_1)}{\nu_1(t_1 - t_0)} - \frac{P_1(t_1')}{\nu_1(t_1' - t_0')}}. \quad (11)$$

The time difference $t_2-t_1$ is just $P_2(t_2)/\nu_1(t_2-t_1)$. The four average frequencies of the first oscillator 52 are not known, but negligible errors are made if they are all set to equal $\nu_1(t_0/t_0)$, the optimum estimate of the frequency of the first oscillator 52 at time $t_0$ based on all measurements through time $t_0$. The final result is $$\phi_{21}(t_2) \approx 2\pi[N_2(t_2) - N_1(t_1)] - \frac{2\pi P_2(t_2)[N_1(t_1) - N_1(t_1')]}{Q[K(t_0) - K(t_0')] + P_1(t_1) - P_1(t_1')}. \quad (12)$$

By employing an appropriate computer or processor, the phase difference between the oscillators can thus be calculated. If the first oscillator operates at nominal 5 MHz frequency stable to $10^{-12}$ over one second, then the approximation results in a fractional error of order $10^{-12}$ cycle or $2\times10^{-19}$ second.

Figure 4:
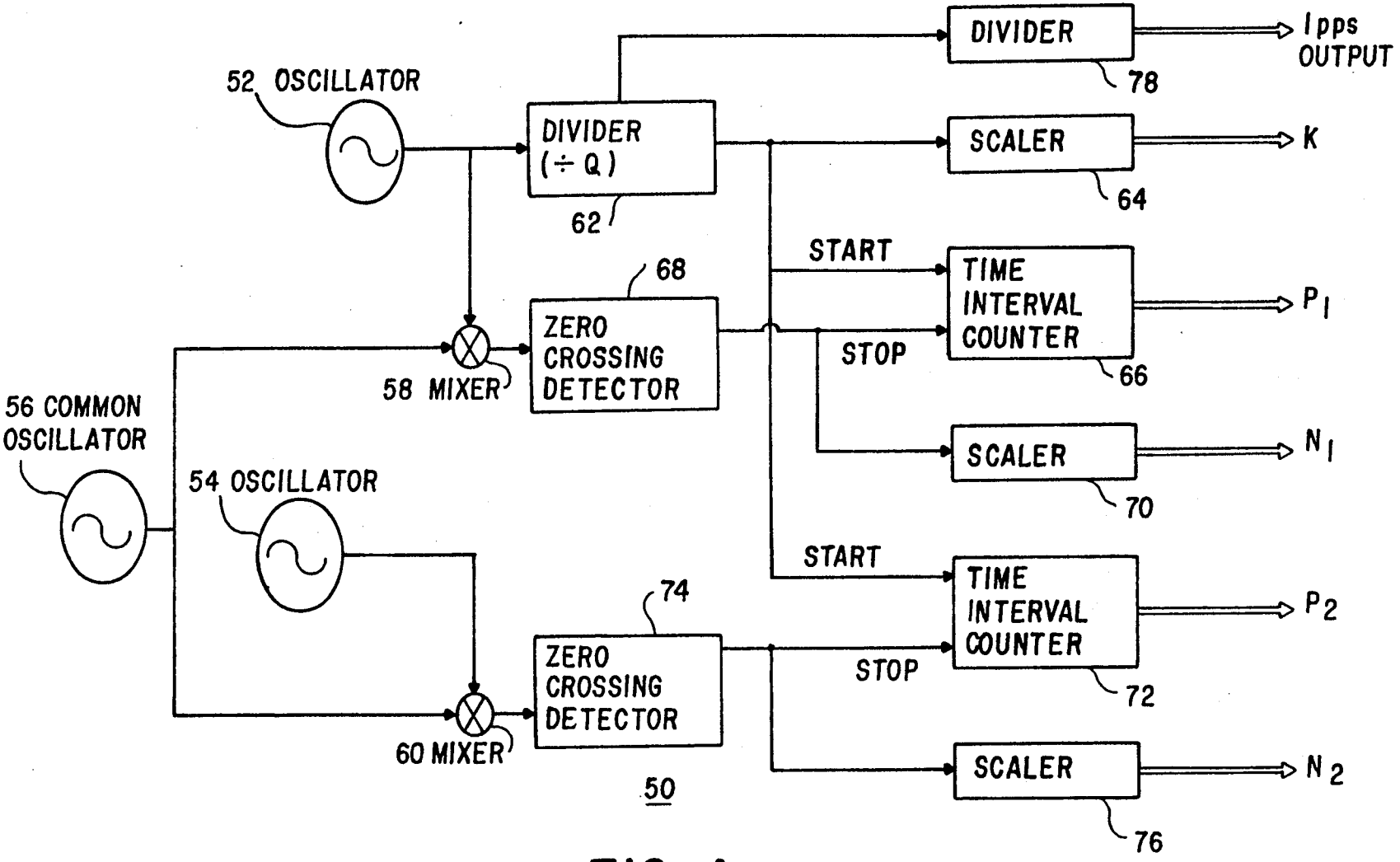
FIG. 4 is a block diagram of an advanced measurement system according to a second embodiment of the present invention.

As will be appreciated by users of the present invention, this common oscillator approach may also employ somewhat modified circuits. For example, FIG. 4 illustrates a circuit diagram of an alternative circuit for the advanced clock measurement system according to the present invention. In this embodiment, measured time intervals each have the same start time. In this technique, the time of each phase difference measurement is referenced to the same time. In this regard, the output signal from the divider 62 is employed as the start signal for each time interval counter in the circuit, as illustrated in FIG. 4.

As in the original circuit (FIG. 3), a computer or processor of some type is employed to calculate the phase difference between the first and second oscillators. However, given that the start time is now the same for each time interval counter, the phase difference (as provided by Equation 12 in the first embodiment) will be slightly different from that for the first embodiment. All other factors and variables being the same, it can be shown that the phase difference for this circuit will be $$\Phi_{21}(t_0) \approx 2\pi[N_2(t_2) - N_1(t_1)] - \frac{2\pi[N_2(t_2) - N_2(t_2')]P_2(t_2)}{[K(t_0) - K(t_0')]Q + P_2(t_2) - P_2(t_2')} + \frac{2\pi[N_2(t_1) - N_1(t_1')]P_1(t_1)}{[K(t_0) - K(t_0')]Q + P_1(t_1) - P_1(t_1')} \quad (13)$$

By employing an appropriate computer or processor, the phase difference between the oscillators can be calculated using the time intervals and zero upcrossings measured by this circuit.

Figure 5:
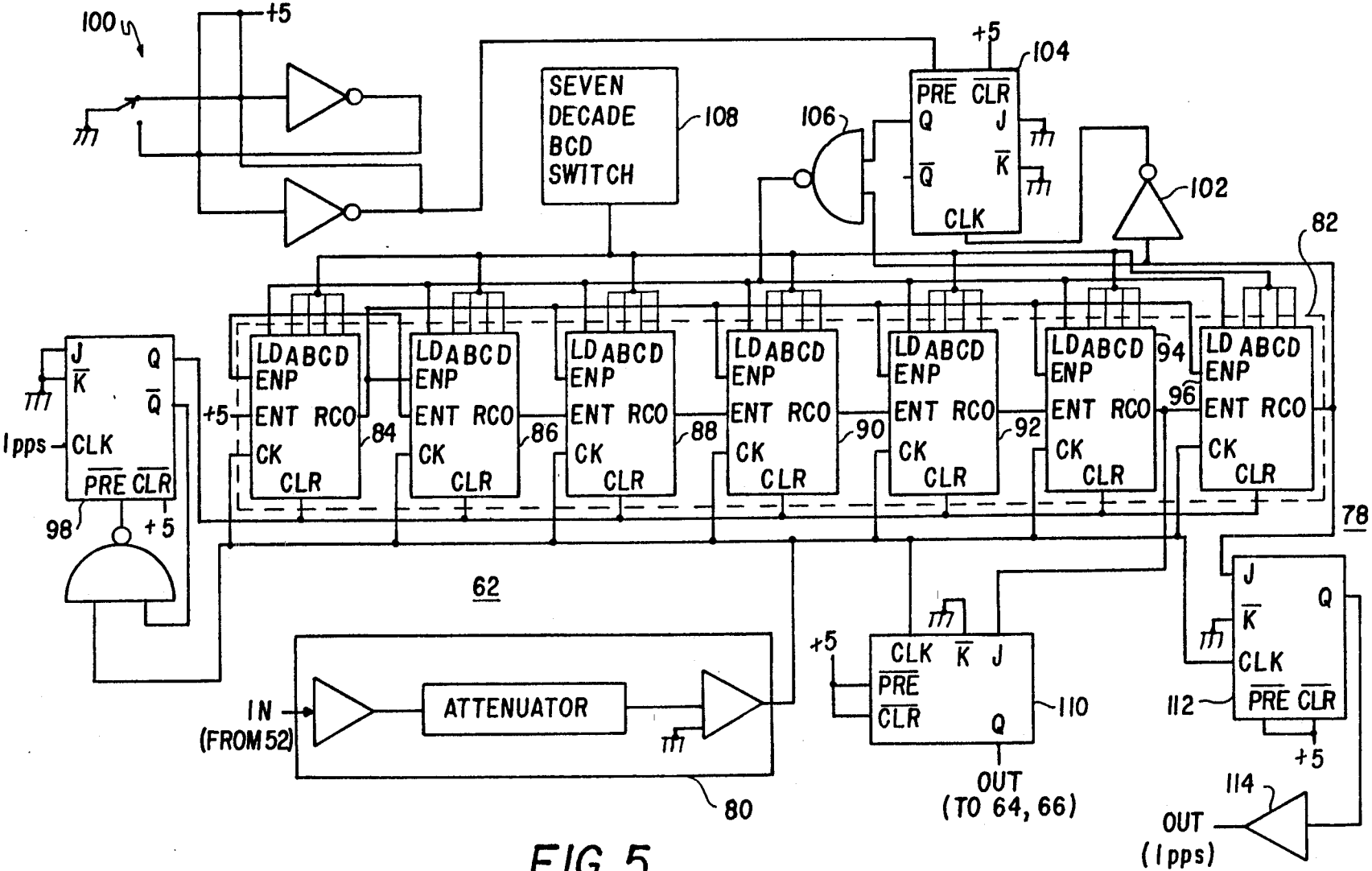
FIG. 5 is a more detailed circuit diagram of the new elements of the advanced clock measurement system of FIG. 3.

FIG. 5 is a more detailed circuit diagram of the dividers 62, 78. In practice, it may be desirable to synchronize the output of the divider 62 with an external signal having a known frequency. FIG. 5 illustrates a divider 62 in which a signal from oscillator can be synchronized to within 100 ns with an external digital signal having a frequency of one pulse per second and such that the signal output by the divider 62 may also be offset by a desired amount, such as 100 msec. Further, the divider 62 can be used in combination with the second divider 78 to produce a 1 pps output signal. The operation of the divider will now be discussed.

The divider 62 illustrated in FIG. 5 employs a number of TTL components, although the same function can be performed with other types of components. In order to drive the TTL components of the divider 62, the analog input signal from the first oscillator 52 is converted into a TTL signal by a comparator 80. The TTL signal is then input to a synchronous divider with ripple carry 82. The synchronous divider 82 includes a series of decade stages 84–96 which are connected in series. The counters 84–96 are clocked together such that there is only a one-gate delay from the input to the final output. The square wave signal from the oscillator 52 via the comparator 80 is used as the clock input CK for each of the stages 84–96.

If the signal is to be synchronized with an externally applied one pulse per second signal, a one pulse per second synchronizing signal is input to a clock input of an optional flip-flop 98. The Q output of the flip-flop 98 is used as the clear input CLR for each of the counters 84–96. If a time offset is desired, an optional circuit which includes a momentary push-button switch 100, an invertor 102, a flip-flop 104, a NAND gate 106 and a seven decade BCD switch 108 provide the desired offset. The RCO output from the last series-connected decade stage 96 is inverted by the invertor 102 and provided as the clock input CLK of the flip-flop 104. The Q output of the flip-flop 104 and the RCO output of the last divider 96 drive the NAND gate 106, the output of which is used as the LD input to load data into each of the decade stages 84–96. The BCD switch 108 provides the data for data inputs A, B, C, and D of each decade stage 84–96.

The RCO output of the sixth decade stage 96 is used to provide the signal which will typically act as the input for the first scaler 64 and the START signal for the first time interval counter 66, and typically has a frequency nearly equal to the frequency difference between the first oscillator 52 and the common oscillator 56. This RCO output is employed as the J input of a flip-flop 110. The output of the comparator 80 is used as the CLK input of the flip-flop 110. The Q output has the desired frequency and is input to the scaler 64 and the time interval counter 66.

The RCO output of the final divider 96 is also used as the J input for a flip-flop 112. The combination of the seventh decade stage 96 and the flip-flop 112 effectively further divide the original input signal, and the flip-flop 112 functions as a one pulse per second output pulse selector. The clock input CLK of the selector flip-flop 112 is the square wave output of the oscillator 52. The Q output of the flip-flop 112 is a one pps signal in this configuration. In order to drive the other TTL components of the advanced clock measurement system, the Q output of the flip-flop 108 is applied to an amplifier 114. Together, these components function as the second divider.

The circuitry of the dividers 62, 78 can be modified so that the output(s) can have any desired value, as other values may be useful for measuring the phase difference between clocks, such as the one pps output of the flip-flop 112. For example, a higher output frequency allows more frequent measurements.

While one embodiment of the invention has been discussed, it will be appreciated by those skilled in the art that various modifications and variations are possible without departing from the spirit and scope of the invention.

I claim:

1. A measurement system for observing time differences between at least two oscillators, comprising:

a common oscillator, separate from the at least two oscillators, for producing a first output signal;

at least two mixers, one associated with each of the at least two oscillators, each for mixing an output signal from the associated oscillator with the first output signal;

means for dividing the output signal from a first of the at least two oscillators;

means for detecting and counting respective zero crossings of respective signals output from each of said mixers and said dividing means;

means for counting time intervals between the zero crossings of the output of said mixer associated with the first oscillator and the output of the remaining mixers and said dividing means; and means for determining time differences between the at least two oscillators based on the counted zero crossings and counted time intervals.

2. A measurement system according to claim 1, wherein said means for detecting and counting detects and counts zero upcrossings of the respective signals.

3. A measurement system according to claim 2, wherein said means for detecting and counting comprises zero crossing detectors, one associated with each of said mixers, for detecting the zero upcrossings, and scalers, one operatively connected with each of said dividing means and the zero crossing detectors, for counting the zero upcrossings.

4. A measurement system according to claim 1, wherein said dividing means comprises a synchronous divider.

5. A measurement system according to claim 4, wherein said dividing means further comprises means for synchronizing the divided signal with an external signal.

6. A measurement system according to claim 1, wherein said determining means comprises a computer.

7. A measurement system according to claim 1, wherein the oscillators comprise molecular clocks.

8. A measurement system according to claim 7, wherein the molecular clocks comprise cesium clocks.

9. A system for measuring time differences between clocks in an ensemble of clocks, comprising:

a common oscillator for producing a first output signal;

a plurality of mixers, one associated with each clock in the ensemble, each for mixing the first output signal and a signal output by the associated clock;

means for dividing the signal output from a first clock in the ensemble;

means for detecting zero upcrossings of an output of each of said mixers;

means for counting the zero upcrossings of the output of each of said mixers and said dividing means;

means for counting time intervals between the zero upcrossings of the signal output from the mixer associated with the first clock and the signals output from said dividing means and the remaining clocks in the ensemble; and means for calculating frequency differences between the clocks in the ensemble based on the counted zero crossings and the counted time intervals.

10. A system for measuring time differences according to claim 9, wherein said means for detecting zero upcrossings comprises a zero crossing detector associated with each of said mixers, and said means for counting zero upcrossings comprises a plurality of scalers, one operatively associated with each of said means for dividing and said zero crossing detectors.

11. A system for measuring time differences according to claim 10, wherein said means for counting time intervals comprises a time interval counter operatively associated with each of said zero crossing detectors.

12. A system for measuring frequency differences according to claim 11, wherein each of the time interval counters has a start input and a stop input, and wherein a first time interval counter associated with the first clock has the start input connected to the output of said means for dividing and the stop input connected to the zero crossing detector associated with the first clock, and each time interval counter associated with the remaining clocks has the start input connected to the output of the zero crossing detector associated with the first clock and the stop input connected to the zero crossing detector of its associated clock.

13. A system for measuring time differences according to claim 12, wherein the time interval counter associated with the first clock begins counting when it receives a pulse from said means for dividing and stops counting when it receives a signal from the zero crossing detector associated with the first clock, and each of the remaining time interval counters starts counting when it receives a signal from the zero crossing detector associated with the first clock and stops counting when it receives a signal from the zero crossing detector associated with its associated clock.

14. A system for measuring time differences according to claim 13, wherein said calculating means calculates the phase difference $\phi_{21}(t_2)$ between the first clock and a second clock by solving $$\phi_{21}(t_2) \approx 2\pi[N_2(t_2) - N_1(t_1)] - \frac{2\pi P_2(t_2)[N_1(t_1) - N_1(t_1')]}{Q[K(t_0) - K(t_0')] + P_1(t_1) - P_1(t_1')},$$

where K(t) is the number of zero upcrossings at time t counted by the scaler associated with said dividing means, $P_1(t)$ is the value counted by the time interval counter associated with the first clock at time t, Q is the value by which said dividing means divides the signal output from the first oscillator, $N_1(t)$ is the number of zero upcrossing counted by the scaler associated with the first clock at time t, $P_2(t)$ is the value counted by the time interval counter associated with the second clock at time t, and $N_2(t)$ is the number of zero upcrossings counted by the scaler associated with the second clock at time t.

15. A system for measuring time differences according to claim 9, wherein said calculating means is a computer.

16. A system for measuring time differences according to claim 9, wherein said dividing means comprises a synchronous divider.

17. A system for measuring time differences according to claim 9, wherein the clocks are molecular clocks.

18. A system for measuring time differences according to claim 9, wherein the clocks are cesium clocks.

19. A system for measuring phase differences between clocks in an ensemble comprising:

a common oscillator for outputting a first output signal;

means for dividing a signal output by a first clock of the ensemble;

a scaler for counting the zero upcrossings of the divided signal;

a plurality of channels, one associated with each of the clocks in the ensemble, each comprising:

means for mixing an output signal of the associated clock with the first signal, means for detecting zero upcrossings of the output of the mixer, first means for counting a time interval between a start signal and the zero upcrossing of the associated clock, wherein the start signal is a zero upcrossing of the divided signal for the channel associated with the first clock and a zero upcrossing of the mixed signal from the first channel for the other clocks, and second means for counting the number of zero upcrossings detected by the zero crossing detector; and means for determining the phase differences between the clocks of the ensemble based on the output of said scaler and said first and second counting means.

20. A system according to claim 19, wherein said dividing means comprises a synchronous divider.

21. A system according to claim 20, wherein said dividing means further comprises means for synchronizing the divided signal with an external signal.

22. A system according to claim 19, wherein said determining means comprises a computer.

23. A system according to claim 19, wherein the clocks comprise molecular clocks.

24. A system according to claim 23, wherein the molecular clocks comprise cesium clocks.

25. A measurement system for observing time differences between at least two measuring oscillators comprising:

a common oscillator, separate from the measuring oscillators, for producing a first output signal;

at least two mixers, one associated with each of the measuring oscillators, each for mixing an output signal from the associated measuring oscillator with the first output signal;

means for dividing the output signal from a first of the measuring oscillators;

means for detecting and counting respective zero crossings of respective signals output from each of said mixers and said dividing means;

means for counting time intervals between the zero crossings of the output of said dividing means and the outputs of each of said mixers; and means for determining time differences between the measuring oscillators based on the counted zero crossings and counted time intervals.

26. A measurement system according to claim 25 wherein said means for detecting and counting detects and counts zero upcrossings of the respective signals.

27. A measurement system according to claim 26 wherein said means for detecting and counting comprises zero crossing detectors, one associated with each of said mixers, for detecting the zero upcrossings, and scalers, one operatively connected with each of said dividing means and the zero crossing detectors, for counting the zero upcrossings, and wherein said means for counting time intervals comprises a time interval counter operatively associated with each of the zero crossing detectors.

28. A measurement system according to claim 27, wherein each of the time interval counters has a start input and a stop input, and wherein the start input of each of the time interval counters is connected to the output of said means for dividing, and the stop input for each of the time interval counters is connected to the output of its associated zero crossing detector.

* * * * *